US008727919B1

(12) United States Patent
Gentile

(10) Patent No.: US 8,727,919 B1
(45) Date of Patent: May 20, 2014

(54) ILLUMINATED GAME PROJECTILE WITH EXTERNAL SWITCH ACCESS

(76) Inventor: Robert Gentile, Billerica, MA (US)

( * ) Notice: Subject to any disclaimer, the term of this patent is extended or adjusted under 35 U.S.C. 154(b) by 0 days.

(21) Appl. No.: 13/550,591

(22) Filed: Jul. 16, 2012

Related U.S. Application Data

(60) Provisional application No. 61/507,695, filed on Jul. 14, 2011.

(51) Int. Cl.
*A63B 43/06* (2006.01)

(52) U.S. Cl.
USPC ..... 473/570

(58) Field of Classification Search
USPC ..... 473/570, 571, 593, 594
See application file for complete search history.

(56) References Cited

U.S. PATENT DOCUMENTS

| | | | | | |
|---|---|---|---|---|---|
| 2,020,484 | A | * | 11/1935 | Turner | 473/570 |
| 2,903,820 | A | * | 9/1959 | Bodell | 446/439 |
| 2,942,379 | A | * | 6/1960 | Oman et al. | 446/149 |
| 3,458,205 | A | * | 7/1969 | Douglas et al. | 473/199 |
| 3,580,575 | A | | 5/1971 | Speeth | |
| 3,804,411 | A | | 4/1974 | Hendry | |
| 4,776,589 | A | | 10/1988 | Yang | |
| 5,007,647 | A | | 4/1991 | Gulick | |
| 5,066,011 | A | * | 11/1991 | Dykstra et al. | 473/570 |
| 5,102,131 | A | * | 4/1992 | Remington | 473/570 |
| 5,228,686 | A | * | 7/1993 | Maleyko | 473/570 |
| 5,236,383 | A | | 8/1993 | Connelly | |
| 5,297,981 | A | * | 3/1994 | Maxim et al. | 446/437 |
| 5,330,195 | A | | 7/1994 | Gulick et al. | |
| 5,375,839 | A | * | 12/1994 | Pagani | 473/570 |
| 5,388,825 | A | * | 2/1995 | Myers et al. | 473/570 |
| 5,445,375 | A | * | 8/1995 | Sweeny | 473/570 |
| 5,490,047 | A | * | 2/1996 | O'Rourke et al. | 473/570 |
| 5,564,702 | A | * | 10/1996 | Meffert | 273/153 R |
| 5,609,411 | A | * | 3/1997 | Wang | 362/234 |
| 5,639,076 | A | | 6/1997 | Cmiel | |
| 5,722,906 | A | | 3/1998 | Gentile | |
| 5,725,445 | A | | 3/1998 | Kennedy et al. | |
| 5,779,575 | A | * | 7/1998 | Hsieh | 473/570 |
| 5,888,156 | A | * | 3/1999 | Cmiel et al. | 473/570 |
| 5,924,942 | A | | 7/1999 | Gentile | |
| 5,954,603 | A | * | 9/1999 | Chursinoff | 473/594 |
| 6,042,487 | A | | 3/2000 | Schrimmer et al. | |
| 6,117,030 | A | * | 9/2000 | Green, Sr. | 473/570 |
| 6,142,894 | A | * | 11/2000 | Lee | 473/570 |
| 6,257,995 | B1 | | 7/2001 | Schrimmer et al. | |
| 6,322,465 | B1 | | 11/2001 | Gentile | |
| 6,464,602 | B1 | * | 10/2002 | Rottger | 473/571 |
| 6,666,782 | B1 | * | 12/2003 | Wu | 473/570 |

(Continued)

*Primary Examiner* — Steven Wong
(74) *Attorney, Agent, or Firm* — O'Connell Law Firm; Thomas P. O'Connell

(57) ABSTRACT

An illuminated game projectile with external switch access with a casing, a light source structure within the casing, and an actuating rod or other mechanism for actuating an actuation mechanism of the light source structure from external to the casing. The game projectile casing can be spherical, and the actuation switch can be a depression switch. The actuating rod can have a first end adjacent to the exterior surface of the casing and a second end adjacent to the switch. The casing can alternatively be disk shaped as with a hockey puck or football shaped with first and second ends and a bulbous mid portion. With a puck shape, actuation can be effected by pressing on a face of the puck to press the switch. With a football shape, actuation can be effected by pressing on an end of the football to press the switch.

6 Claims, 5 Drawing Sheets

(56) References Cited

U.S. PATENT DOCUMENTS

| | | | | |
|---|---|---|---|---|
| 6,712,487 | B2 | 3/2004 | Liou | |
| 7,014,581 | B2 * | 3/2006 | Ng | 473/570 |
| 7,140,972 | B2 | 11/2006 | Redwine et al. | |
| 7,179,181 | B2 * | 2/2007 | Ko | 473/570 |
| 7,614,959 | B1 | 11/2009 | Gentile | |
| 7,785,215 | B2 | 8/2010 | Kohnen, II | |
| 2002/0173378 | A1 | 11/2002 | Tinsman | |
| 2003/0224885 | A1 * | 12/2003 | Leal et al. | 473/570 |
| 2005/0005873 | A1 | 1/2005 | Gick | |
| 2007/0021244 | A1 * | 1/2007 | Ko | 473/570 |
| 2007/0281811 | A1 * | 12/2007 | Wang | 473/570 |
| 2008/0039246 | A1 * | 2/2008 | Martino | 473/569 |
| 2008/0234077 | A1 * | 9/2008 | Glowinski | 473/570 |
| 2011/0244981 | A1 | 10/2011 | Schrimmer et al. | |
| 2012/0040785 | A1 * | 2/2012 | De Sort | 473/570 |

* cited by examiner

ILLUMINATED GAME PROJECTILE WITH EXTERNAL SWITCH ACCESS

FIELD OF THE INVENTION

The present invention relates generally to toy and game projectiles. More particularly, disclosed herein is an illuminated game projectile, such as a ball or a puck, with a light source capable of being actuated from external to the game projectile.

BACKGROUND OF THE INVENTION

The prior art has disclosed innumerable game projectile constructions with a nearly endless variety of purposes and effects. Of course, game projectiles have been disclosed that provide illumination. Moreover, game projectiles have been disclosed with switching arrangements for actuating a light source within a game ball between illuminated and non-illuminated conditions. However, the prior art has been notably limited in its ability to provide a game projectile with desired performance characteristics that can readily be switched manually between illuminated and non-illuminated or between other actuation conditions. Accordingly, one knowledgeable in the art will be well aware that there remains a need for such a game projectile.

SUMMARY OF THE INVENTION

Advantageously, the present invention is founded on the most basic object of providing a game projectile that can be switched manually between illuminated and non-illuminated or between other actuation conditions while providing desired performance characteristics.

A more particular object of embodiments of the invention is to provide a game projectile that can be illuminated by a pressing on the game projectile.

A further object of embodiments of the invention is to provide an illuminated game projectile that retains a light source in a concentric disposition relative to an outer shell that resists displacement of the light source even in response to impacts on the game projectile.

A related object of the invention is to provide an illuminated game projectile that is capable of withstanding high impacts while maintaining its structural integrity and while demonstrating consistent performance even after successive impacts relative to the game projectile.

These, and in all likelihood further, objects and advantages of the present invention will become obvious not only to one who reviews the present specification and drawings but also to those who have an opportunity to make use of an embodiment of the game projectile disclosed herein. However, it will be appreciated that, while the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the aforementioned objects, an embodiment of the illuminated game projectile with external switch access is founded on a game projectile casing with an exterior surface. A light source structure is disposed within the game projectile casing. The light source structure has a light source, a power source, and an actuation mechanism that can be actuated from external to the game projectile casing.

In certain embodiments, the game projectile casing can be spherical, and the actuation mechanism can take the form of a depression switch that can be actuated between on and off actuating conditions by a selective depressing of the switch. The light source structure can be centrally disposed within the game projectile casing, and the means for actuating the actuation mechanism from external to the game projectile casing can be a substantially rigid actuating rod with a first end adjacent to the exterior surface of the game projectile casing and a second end adjacent to the depression switch. With that, the light source structure can be substantially concentrically retained within the game projectile casing and actuated from external to the casing.

As taught herein, game projectiles can have game projectile casings with substantially solid cores with a light source reception cavity disposed therewithin that retains the light source structure. A radial access conduit can receive the actuating rod. A plurality of surface deviations can be disposed along the actuating rod to engage positively and grip the access conduit.

The light source structure can have a main body portion with the light source projecting from a first side of the main body portion and the depression switch disposed to a second side of the main body. Under such constructions, the light source reception cavity can have a main cavity that retains the main body portion of the light source structure and a light source reception cavity that receives the light source.

In further embodiments, the game projectile casing can have a hockey puck disk shape with an annular outer peripheral wall and first and second faces retained in spaced relation by the peripheral wall. The means for actuating the actuation mechanism from external to the game projectile casing can comprise a depression switch that can be actuated between on and off actuating conditions by a selective depressing of the switch. Furthermore, the depression switch can be disposed to face the first face of the game projectile casing such that it can be actuated by a pressing on the first face of the game projectile casing.

Under such puck constructions, the game projectile casing could be substantially solid with a light source reception cavity disposed therewithin, and the light source structure can be disposed within the light source reception cavity. The light source structure can have a main body portion with the light source projecting from a first side of the main body portion and the depression switch disposed to a second side of the main body. To accommodate such a light source structure, a light source reception cavity can be disposed within the casing with a main cavity that retains the main body portion of the light source structure and a light source reception cavity that receives the light source. The light source reception cavity could be defined by the body of the casing or by a light capsule. In alternative embodiments, the game projectile casing can be substantially hollow with the light capsule and light source structure disposed therewithin. In a still further detail of the invention, an actuation protuberance can be interposed between the depression switch and the first face of the game projectile casing.

In a further manifestation of the invention, the game projectile casing has an American football shape with first and second ends and a bulbous mid portion. A light capsule is disposed within the first end of the game projectile casing, and the light source structure is retained within the light capsule. The means for actuating the actuation mechanism from external to the game projectile casing can again be a depression switch that can be actuated between on and off actuating conditions by a selective depressing of the switch.

The depression switch can be actuated by a pressing on the first end of the game projectile casing.

A light capsule can define a light source reception cavity, and the light source structure can be disposed within the cavity. Again, the light source structure can have a main body portion with the light source projecting from a first side of the main body portion and the depression switch is disposed to a second side of the main body. To accommodate such a light source structure, the light source reception cavity can have a main cavity that retains the main body portion of the light source structure and a light source reception cavity that receives the light source.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The illuminated game projectile with external switch access disclosed herein is subject to a wide variety of embodiments. However, to ensure that one skilled in the art will be able to understand and, in appropriate cases, practice the present invention, certain preferred embodiments and aspects of preferred embodiments of the broader invention revealed herein are described below and shown in accompanying figures.

Figure 1:
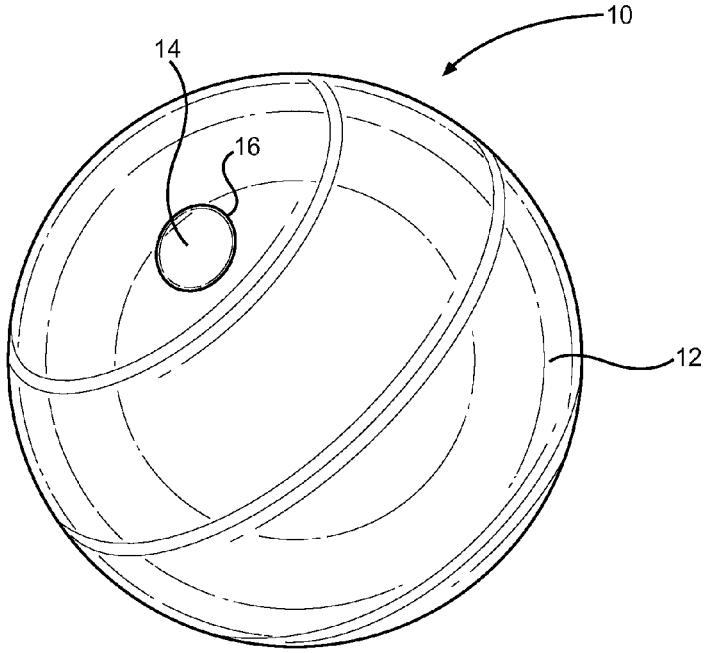
FIG. 1 is a perspective view of a game projectile in the form of a ball according to the present invention.
Figure 2:
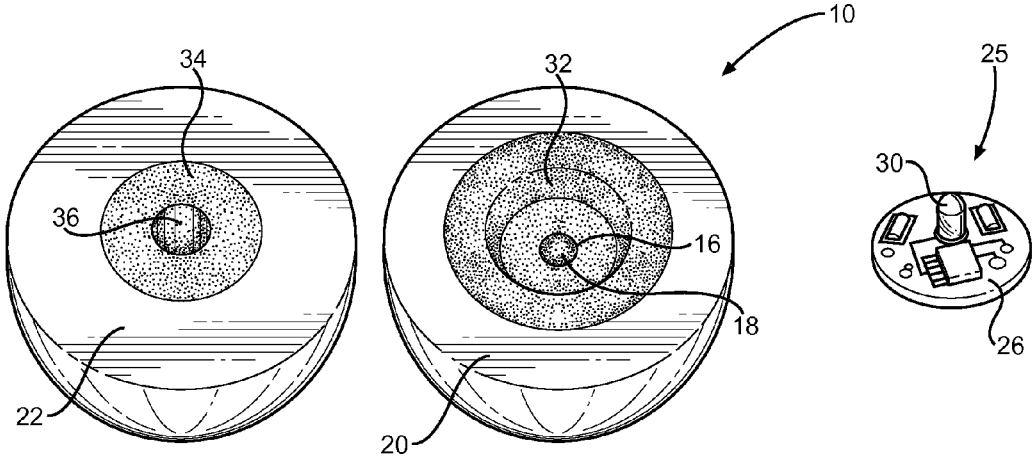
FIG. 2 is a perspective view of the game projectile of FIG. 1 with the hemispheres separated and the light source removed therefrom.
Figure 3:
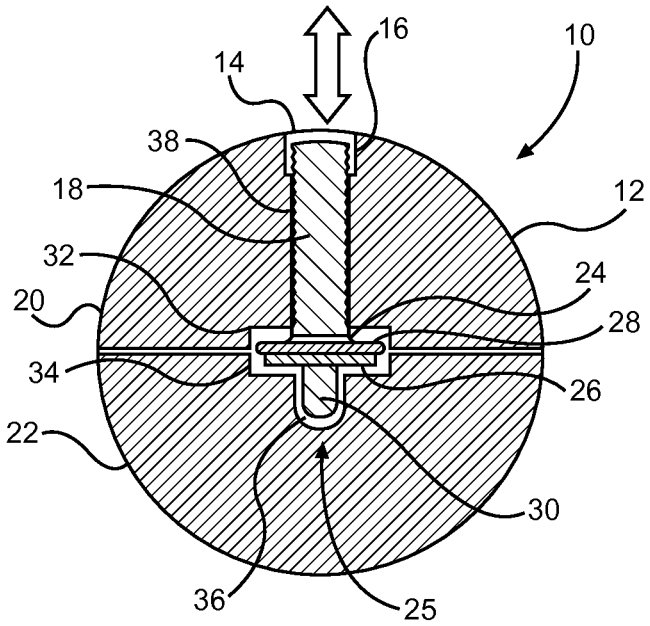
FIG. 3 is a cross-sectional view of the game projectile of FIG. 1.

Turning more particularly to the drawings, an embodiment of the illuminated game projectile according to the present invention is indicated generally at 10 in FIGS. 1 through 3. There, the game projectile 10 takes the form of a spherical ball that is founded on a spherical casing 12. As seen in FIGS. 2 and 3, the spherical casing 12 has a first hemisphere 20 and a second hemisphere 22 that are joined in any effective manner when the projectile 10 is fully assembled. By way of example and not limitation, the first and second hemispheres 20 and 22 could be joined by adhesive, heat or sonic welding, integral formation, or any other effective method or combination thereof. In the depicted embodiment, the first and second hemispheres 20 and 22 are substantially solid cored structures but for light source reception cavities 32, 34, and 36 and the access conduit 16 described further hereinbelow.

The first and second hemispheres 20 and 22 could be formed from any suitable material or combination thereof depending on, among other things, the purpose of the game projectile 10. For example, a game projectile 10 intended for use in field hockey will preferably have a given durometer while a game projectile 10 intended for use in street hockey will likely be ideally formed with a different durometer. The material for the spherical casing 12 and the first and second hemispheres 20 and 22 could be a solid polymeric material, a polymeric material encasing granular material, a ceramic material, wood, metal, or any other material or combination thereof. At least a portion of the hemispheres 20 and 22 can be translucent so that light can pass therethrough.

A light source 25 is substantially concentrically retained within the spherical casing 12 within an open inner volume defined by the light source reception cavities 32, 34, and 36. As shown in FIGS. 2 and 3, the light source reception cavities 32 and 34 in the first and second hemispheres 20 and 22 are disposed in alignment with each cavity 32 and 34 being disk shaped. Together, the disk-shaped cavities 32 and 34 define a reception cavity for the main body portion of the light source 25 formed by a circuit board 26 and a battery 28 retained relative thereto. A light, in this example an LED 30, projects generally concentrically from the circuit board 26 to what may be considered a first side of the main body portion of the light source 25. An actuating switch 24 that can be pressed between actuating conditions is disposed generally concentrically on the light source 25 to what may be considered a second side of the main body portion of the light source 25. A bulbous light source reception cavity 36 is concentrically disposed in the light source reception cavity 34 for matingly receiving the LED 30. The base of the light source reception cavity 34 thus acts as an annular shoulder for supporting the main body portion of the light source 25 with the bulbous light source reception cavity 36 concentrically disposed relative thereto. Actuation of the light source 25 will cause light to be emitted by the LED and propagated through and from the spherical casing 12.

An actuation conduit 16 in the first hemisphere 20 has a proximal end continuous with or adjacent to the light source reception cavity 32 and a distal end continuous with or adjacent to the outer surface of the first hemisphere 20. A substantially rigid actuating rod 18 is disposed within the actuation conduit 16 with a first end adjacent to the proximal end of the actuation conduit 16 and a second end adjacent to the distal end of the actuation conduit 16. An end cap 14 encases the second end of the actuating rod 18 by having a peripheral wall that encircles the second end of the actuating rod 18 and a base wall that overlies the second end of the actuating rod 18. The end cap 14 is contiguous with the exterior surface of the first hemisphere 20, and the base wall of the end cap 14 can be convex to match the shape of the exterior surface of the first hemisphere 20. As seen best in FIG. 3, the actuating rod 18 in this embodiment has a plurality of serrations, ridges, threads, or other surface deviations 38 disposed therealong. With that, the surface deviations 38 will tend to engage positively and grip the wall that defines the actuation conduit 16 to prevent inadvertent dislodging of the actuating rod 18 relative to the actuation conduit 16.

Under this configuration, the game projectile 10 can be caused to illuminate by a pressing on the second end of the actuating rod 18, in this case through the cap 14, to cause the first end of the actuating rod 18 to depress the actuating switch 24. Depression of the actuating switch 24 will allow power to pass from the battery 28 to the LED 30. Where the material of the first hemisphere 20 or at least the material defining the actuation conduit 16 is resilient, the material can facilitate a resilient depression of the actuating rod 18. When illumination from the light source 25 is no longer desired, the actuating rod 18 can again be pressed to depress the actuating switch 24 thereby to terminate the flow of power from the battery 28 to the LED 30. Other means for actuating the light source 25, such as an impact switch, remote actuation, or any other actuation method, would additionally or alternatively be possible. The illumination could be constant, intermittent, or in some random or consistent pattern.

Figure 4:
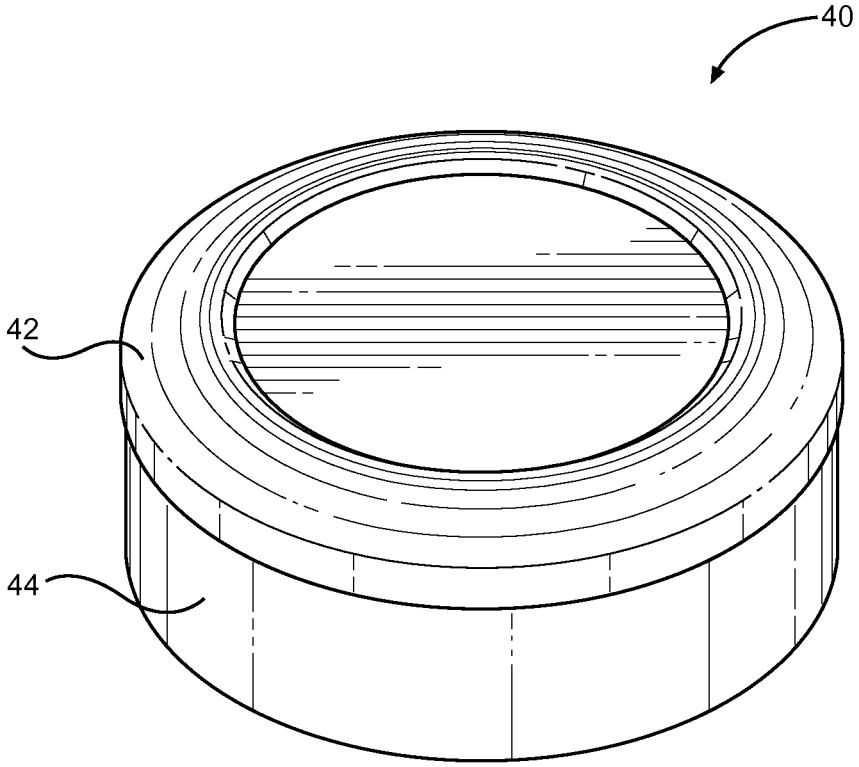
FIG. 4 is a perspective view an alternative game projectile according to the invention.
Figure 5:
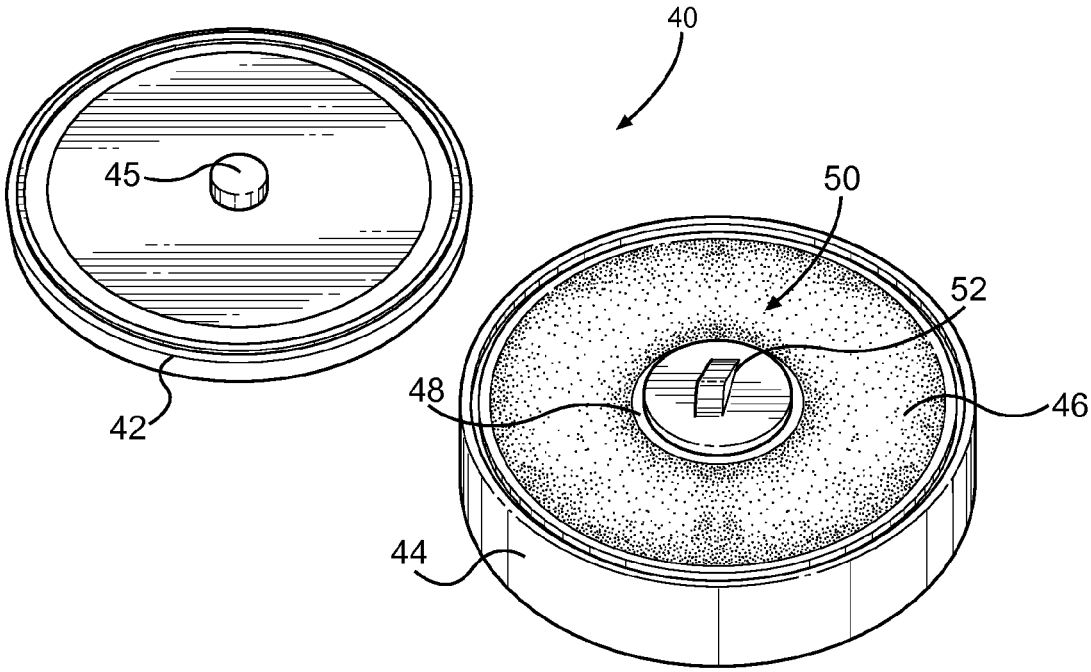
FIG. 5 is a perspective view of the game projectile of FIG. 4 with the upper portion separated from the lower portion.
Figure 6:
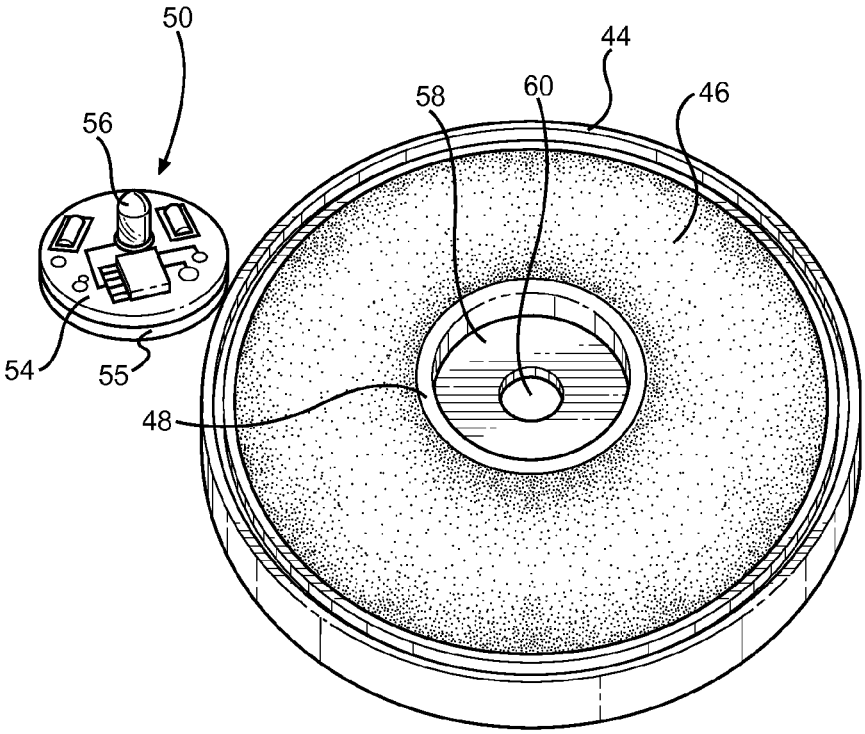
FIG. 6 is a perspective view of the lower portion of the game projectile of FIG. 5 with the light source removed therefrom.

Further embodiments of the game projectile are possible and within the scope of the invention. By way of example, an alternative game projectile is indicated at 40 in FIGS. 4 through 6. There, the game projectile 40 takes the form of a puck with an upper portion 42 and a lower portion 44. In the depicted example, the upper portion 42 essentially comprises a flat top lid, and the lower portion 44 comprises a flat bottom lid with an annular peripheral wall. It will be appreciated, however, that the upper and lower portions 42 and 44 could be otherwise configured, such as with the upper and lower portions 42 and 44 each having lid portions and peripheral wall portions or with the lower portion 44 comprising only a flat bottom lid.

The inner volume of the game projectile 40 has a core material 46 that is substantially solid but for a light capsule 48 that is fixed in a concentric position within the core material 46. The core material 46 can be the same as or different from the material forming the upper and lower portions 42 and 44. The upper and lower portions 42 and 44 and the core material 46 in this embodiment are formed from a resilient polymeric material of a given durometer. The upper and lower portions 42 and 44 could be molded or otherwise formed from rubber, plastic, or any other suitable material or combination thereof.

The light capsule 48 defines an open inner volume for receiving a light source 50 that again has a main body portion defined by a circuit board 54, a battery 55, and a light 56, again an LED, that projects from a concentric position on the circuit board 54 to a first side of the light source 50. An actuating switch 52 is disposed to the second side of the light source 50. The light capsule 48 has an annular shoulder 58 for supporting the main body portion of the light source 50 and a bulbous light cavity 60 concentrically disposed for receiving the light 56.

When the game projectile 40 is assembled, the light source 50 is disposed within the light capsule 48 with the light 56 received within the light cavity 60 and the actuating switch 52 disposed facing the flat upper lid that forms the upper portion 42. With the actuating switch 52 disposed in immediate proximity to the flexible lid that forms the upper portion 42, the game projectile 40 can be caused to illuminate or to cease illuminating by a pressing on the exterior surface of the upper portion 42. An actuation button 45 can be interposed between the switch 52 and the upper portion 42 for ensuring a positive actuation of the switch 52 upon a pressing on a central area of the upper portion 42. The actuation button 45 can be fastened to or formed with the upper portion 42. Alternatively, it could be retained by the light source 50 or in some other manner.

Figure 7:
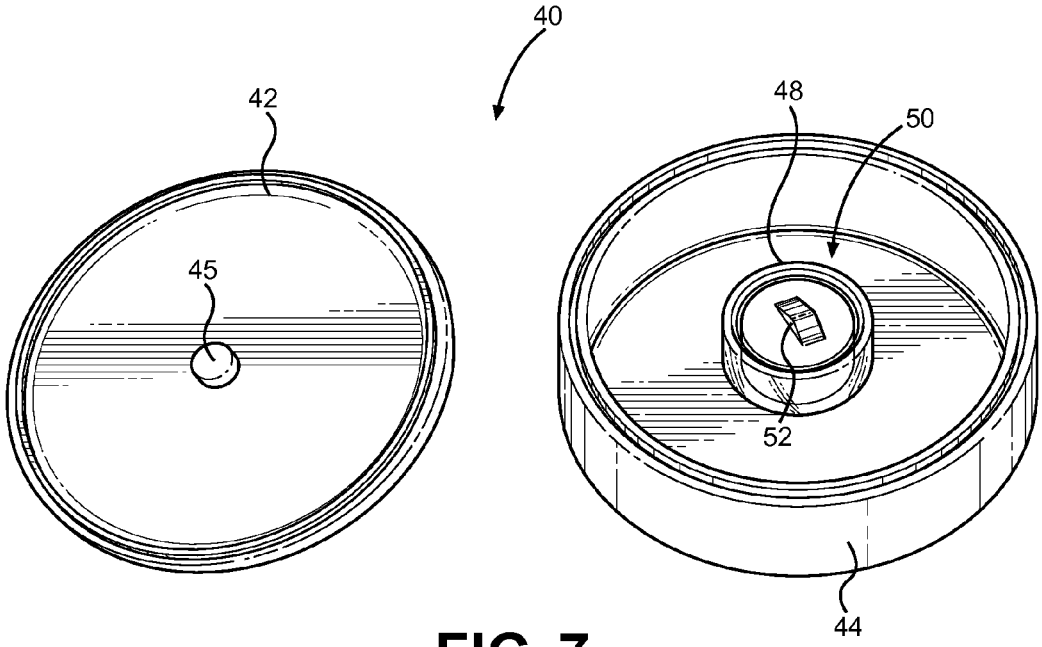
FIG. 7 is a perspective view of another game projectile pursuant to the invention with the upper portion opened from the lower portion.
Figure 8:
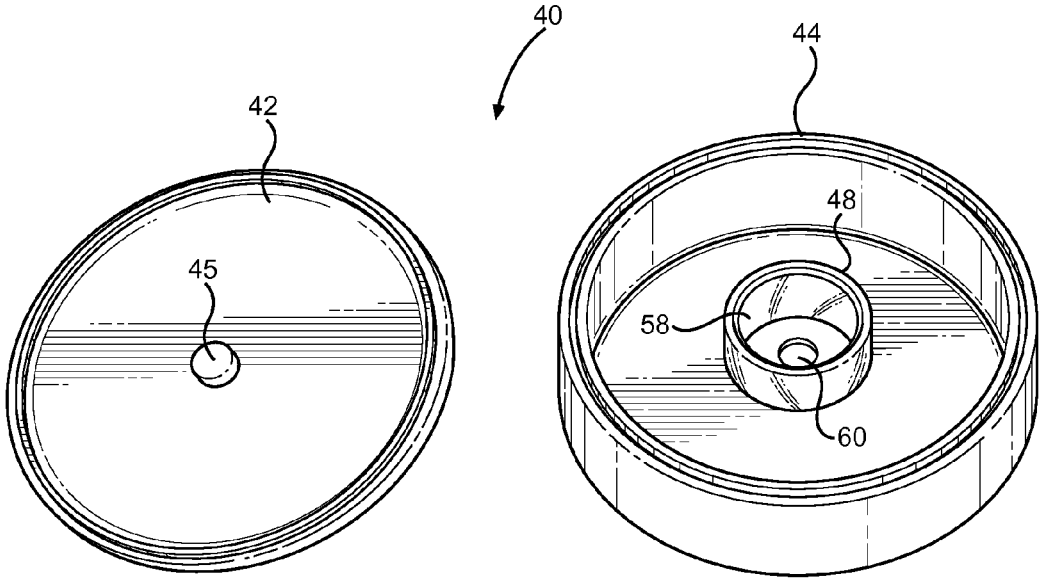
FIG. 8 is a perspective view of the game projectile of FIG. 8 with the light source removed therefrom.

Looking to FIGS. 7 and 8, another game projectile 40 is shown in the form of a puck. The game projectile 40 again has an upper portion 42 and a lower portion 44. Here, however, the inner volume of the game projectile 40 is devoid of a core material. The light capsule 48 is fixed in a concentric disposition relative to the lower portion 44 and the game projectile 40 in general. The light capsule 48 could be fixed in any effective manner, whether by integral formation, adhesive, mechanical fastening, sonic or heat welding, or any other method or combination thereof.

As before, the light capsule 48 defines an open inner volume for receiving a light source 50 that again has a main body portion defined by a circuit board 54, a battery 55, and a light 56 that projects from a concentric position on the circuit board 54 to a first side of the light source 50. An actuating switch 52 is disposed to the second side of the light source 50. The light capsule 48 has an annular shoulder 58 for supporting the main body portion of the light source 50 and a bulbous light cavity 60 concentrically disposed for receiving the light 56.

When the game projectile 40 is assembled, the light source 50 is disposed within the light capsule 48 with the light 56 received within the light cavity 60 and the actuating switch 52 disposed facing the flat upper lid that forms the upper portion 42. With the actuating switch 52 disposed in immediate proximity to the flexible lid that forms the upper portion 42, the game projectile 40 can be caused to illuminate or to cease illuminating by a pressing on the exterior surface of the upper portion 42. An actuation button or protuberance 45 can be interposed between the switch 52 and the upper portion 42 for ensuring a positive actuation of the switch 52 upon a pressing on a central area of the upper portion 42. Again, the actuation button 45 can be fastened to or formed with the upper portion 42. Alternatively, it could be retained by the light source 50 or in some other manner.

Figure 9:
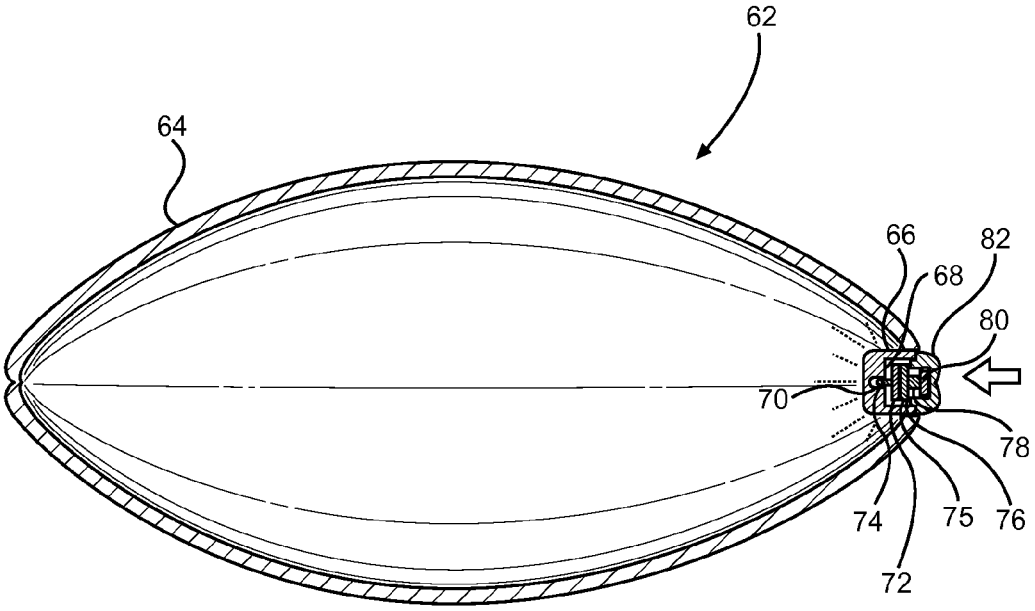
FIG. 9 is a cross-sectional view of a game projectile according to the invention in the form of a football.

Still another game projectile, which in this embodiment takes the form of a football 62, is shown in cross-section in FIG. 9. The football game projectile 62 has a main body 64 having the shape of an American football with first and second ends and a bulbous mid portion. Under this construction, a light capsule 66 is fixed within the first end of the main body 64. The light capsule 66 could be fixed in any effective manner, whether by integral formation, adhesive, mechanical fastening, sonic or heat welding, or any other method or combination thereof.

The light capsule 66 defines an open inner volume for receiving a light source 75 that again has a main body portion defined by a circuit board 72, a battery 76, and a light 74 that projects from a concentric position on the circuit board 72 to a first side of the light source 75. An actuating switch 78 is disposed to the second side of the light source 75. The light capsule 66 has an annular shoulder 68 for supporting the main body portion of the light source 75 and a bulbous light cavity 70 concentrically disposed for receiving the light 74.

Where the switch 78 is a push button or depression switch, actuation of the switch 78 can be triggered in a variety of ways, including by rotation of a threadedly-engaged cap or by a manual depression of the switch 78. In this embodiment, a cap member 82 of flexible material, such as rubber or another polymeric material, overlies the switch 78 and the light capsule 66 and light source 75 in general. The cap member 82 in this construction simulates the shape of a traditional football end portion. The cap member 82 can be retained in any effective manner, whether by a threaded engagement, adhesive, integral formation, sonic or heat welding, or any other method or combination thereof. An actuation button 80 can be interposed between the switch 78 and the cap member 82 for ensuring a positive actuation of the switch 78 upon a pressing on the cap member 82. The actuation button 80 can be fastened to or formed with the cap member 82. Alternatively, it could be retained by the light source 75 or in some other manner. Of course, other types of switches are possible and within the scope of the invention except as it might be expressly limited. For example, the switch 78 could additionally or alternatively comprise an impact switch, a toggle switch, or any other type of switch.

In each embodiment, the battery 28, 55, or 76 can be removable and replaceable. Additionally or alternatively, the battery 28, 55, or 76 could be recharged, such as by an insertion of an electrically-conductive member through an aperture (not shown). The electrically-conductive probe member would itself receive power from a power source, which could be a source of battery power, AC power, or some other power source. Alternatively, the battery 28 or 55 could be recharged by any other effective method, such as by wireless energy transfer through a power mat or the like.

Game projectiles according to the invention can be particularly crafted for any use, whether as a street hockey ball, a jai alai ball, vented balls such as those commonly sold under the registered trademark WIFFLE® of The Wiffle Ball, Inc. of Shelton, Conn., a golf ball, a lacrosse ball, a baseball, a volleyball, a ping pong ball, a simply play ball, a hockey puck, a football, a soccer ball, a bocce ball, or any other game projectile. Alternatively, the game projectile could be constructed for use as a dog or cat ball or for substantially any other purpose. In any event, when constructed as described herein, the game projectile can withstand impacts and rugged use while maintaining the light source in a properly centered disposition. A further understanding of potential details and alternatives for the components of the game projectile can be had by reference to the present inventor's U.S. Pat. No. 7,614,959 for a High Impact Game Ball Construction Method and Device, which is incorporated herein by reference.

Where the game projectile takes the form of a hockey puck 40, it could be a street hockey puck, an ice hockey puck, or some other type of puck, and it will be appreciated that the hockey puck 40 could incorporate further features within the scope of the invention. For example, the present inventor has further appreciated that it could be advantageous in particular embodiments to have a puck 40 with rounded upper and lower peripheral edges so that the peripheral wall of the puck 40 would have an arcuate configuration. Under such a construction, the puck 40 will tend to glide and travel over obstacles more easily.

With a plurality of exemplary embodiments and details of the present invention for an illuminated game projectile with external switch access disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. An illuminated game projectile with external switch access, the game projectile comprising:

a game projectile casing with an exterior surface wherein the game projectile casing comprises a spherical casing;

a light source structure disposed within the game projectile casing, the light source structure comprising a light source, a power source, and an actuation mechanism; and means for actuating the actuation mechanism from external to the game projectile casing wherein the actuation mechanism comprises a depression switch that can be actuated between on and off actuating conditions by a selective depressing of the switch;

wherein the light source structure is centrally disposed within the game projectile casing;

wherein the means for actuating the actuation mechanism from external to the game projectile casing comprises a substantially rigid actuating rod with a body portion, a first end adjacent to the exterior surface of the game projectile casing, and a second end adjacent to the depression switch;

wherein the game projectile casing has a radial access conduit that receives the actuating rod;

a plurality of peripheral surface deviations spaced along the body portion of the actuating rod to engage positively and grip the access conduit;

wherein the game projectile casing has a substantially solid core with a light source reception cavity disposed therewithin that retains the light source structure wherein the actuating rod and the surface deviations spaced along the body portion of the actuating rod are in direct contact with the substantially solid core of the game projectile casing over at least a portion of the radial access conduit.

2. The game projectile of claim 1 wherein the light source structure is substantially concentrically retained within the game projectile casing.

3. An illuminated game projectile with external switch access, the game projectile comprising:

a game projectile casing with an exterior surface wherein the game projectile casing comprises a spherical casing;

a light source structure disposed within the game projectile casing, the light source structure comprising a light source, a power source, and an actuation mechanism; and means for actuating the actuation mechanism from external to the game projectile casing wherein the actuation mechanism comprises a depression switch that can be actuated between on and off actuating conditions by a selective depressing of the switch;

wherein the light source structure is centrally disposed within the game projectile casing;

wherein the means for actuating the actuation mechanism from external to the game projectile casing comprises a substantially rigid actuating rod with a body portion, a first end adjacent to the exterior surface of the game projectile casing, and a second end adjacent to the depression switch;

wherein the game projectile casing has a radial access conduit that receives the actuating rod;

a plurality of peripheral surface deviations spaced along the body portion of the actuating rod to engage positively and grip the access conduit;

wherein the game projectile casing has a substantially solid core with a light source reception cavity disposed therewithin that retains the light source structure;

wherein the light source structure has a main body portion wherein the light source projects substantially concentrically from a first side of the main body portion and wherein the depression switch is substantially concentrically disposed to a second, opposite side of the main body and wherein the light source reception cavity has a main cavity that retains the main body portion of the light source structure and a substantially concentric light source reception cavity that receives the light source wherein the light source reception cavity has a base portion that acts as an annular shoulder for supporting the main body portion of the light source structure.

4. The game projectile of claim 3 further comprising an end cap disposed over the first end of the actuating rod wherein the end cap has a base wall contiguous with the exterior surface of the game projectile casing and wherein the end cap has a convex end cap that substantially matches the exterior surface of the game projectile casing in shape.

5. The game projectile of claim 1 wherein the peripheral surface deviations spaced along the body portion of the actuating rod comprise serrations spaced along the body portion of the actuating rod.

6. The game projectile of claim 5 wherein the serrations spaced along the body portion of the actuating rod comprise threads along the body portion of the actuating rod.

* * * * *